US011788375B2

(12) United States Patent
Graham

(10) Patent No.: US 11,788,375 B2
(45) Date of Patent: Oct. 17, 2023

(54) RESILIENT MATRIX SUSPENSION FOR FRANGIBLE COMPONENTS

(71) Applicant: Schlumberger Technology Corporation, Sugar Land, TX (US)

(72) Inventor: Robert Matthew Graham, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 115 days.

(21) Appl. No.: 16/882,831

(22) Filed: May 26, 2020

(65) Prior Publication Data

US 2020/0378211 A1 Dec. 3, 2020

Related U.S. Application Data

(60) Provisional application No. 62/854,773, filed on May 30, 2019.

(51) Int. Cl.

| | |
|---|---|
| ***E21B 33/12*** | (2006.01) |
| ***E21B 43/26*** | (2006.01) |
| ***E21B 33/134*** | (2006.01) |
| ***E21B 33/128*** | (2006.01) |
| ***E21B 33/129*** | (2006.01) |

(52) U.S. Cl.

CPC ..... *E21B 33/1216* (2013.01); *E21B 33/128* (2013.01); *E21B 33/134* (2013.01); *E21B 43/261* (2013.01); *E21B 33/1208* (2013.01); *E21B 33/129* (2013.01)

(58) Field of Classification Search

CPC .. E21B 33/1216; E21B 33/128; E21B 33/134; E21B 43/261; E21B 33/1208; E21B 33/129; E21B 33/1291

See application file for complete search history.

(56) References Cited

U.S. PATENT DOCUMENTS

| | | | | |
|---|---|---|---|---|
| 3,323,326 | A * | 6/1967 | Vertson | E21B 17/07 175/323 |
| 4,614,346 | A * | 9/1986 | Ito | E21B 33/1277 166/187 |
| 8,997,853 | B2 | 4/2015 | VanLue | |
| 9,316,086 | B2 | 4/2016 | VanLue | |
| 9,739,106 | B2 | 8/2017 | Tse | |
| 10,024,126 | B2 | 7/2018 | Davies et al. | |
| 2016/0061000 | A1* | 3/2016 | Rochen | B29C 45/14 166/138 |
| 2016/0123100 | A1* | 5/2016 | Tse | E21B 33/128 166/387 |

FOREIGN PATENT DOCUMENTS

WO 2015077225 A1 5/2015

OTHER PUBLICATIONS

Dictionary.com, elastomer, 2016 (Year: 2016).*
Dictionary.com, frangible, 2016 (Year: 2016).*

* cited by examiner

*Primary Examiner* — Nicole Coy
*Assistant Examiner* — Nicholas D Wlodarski
(74) *Attorney, Agent, or Firm* — Michael Wills, III

(57) ABSTRACT

A backup ring includes a plurality of segments defined by a plurality of slots, wherein each segment is defined by a sequential pair of the plurality of slots, and a resilient matrix material that at least partially fills each slot of the plurality of slots.

6 Claims, 3 Drawing Sheets

RESILIENT MATRIX SUSPENSION FOR FRANGIBLE COMPONENTS

CROSS-REFERENCE TO RELATED APPLICATION

This application based on and claims priority to U.S. Provisional Patent Application Ser. No. 62/854,773, filed May 30, 2019, which is incorporated herein by reference in its entirety.

BACKGROUND

In a variety of well fracturing applications, a wellbore is initially drilled and cased. A composite frac plug is then pumped down and actuated to form a seal with the surrounding casing. Once the casing is perforated, the frac plug is used to prevent fracturing fluid from flowing farther downhole, thus forcing the fracturing fluid out through the perforations and into the surrounding formation. In some applications, multiple frac plugs may be deployed to enable fracturing at different well zones. Each frac plug includes a sealing element, which is deformed into sealing engagement with the surrounding casing. The frac plug may also include at least one backup ring disposed adjacent the sealing element. It is desirable to improve the reliability of the composite frac plug by preventing its frangible components from breaking prematurely.

SUMMARY

According to one or more embodiments of the present disclosure, a backup ring includes a plurality of segments defined by a plurality of slots, wherein each segment is defined by a sequential pair of the plurality of slots; and a resilient matrix material that at least partially fills each slot of the plurality of slots.

According to one or more embodiments of the present disclosure, a method includes applying a resilient matrix material to an end of a sealing element, wherein the resilient matrix material is applied as a liquid gel; mating a backup ring with the end of the sealing element, the backup ring including a plurality of segments defined by a plurality of slots, wherein each segment is defined by a sequential pair of the plurality of slots, wherein mating the backup ring with the end of the sealing element causes the resilient matrix material to at least partially fill each slot of the plurality of slots; and allowing the resilient matrix material to cure into a solid.

According to one or more embodiments of the present disclosure, a method includes deploying a downhole tool into a cased wellbore; and anchoring the downhole tool to the cased wellbore, wherein the downhole tool includes a backup ring including a plurality of segments defined by a plurality of slots, wherein each segment is defined by a sequential pair of the plurality of slots; and a resilient matrix material that at least partially fills each slot of the plurality of slots.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the apparatus and/or method may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to an apparatus and method for facilitating a fracturing operation. Specifically, one or more embodiments of the present disclosure are directed to using a resilient matrix material, such as silicone or rubber, to at least partially fill slots between segments of a frangible backup ring for use in a downhole tool during a fracturing operation. Advantageously, application of the resilient matrix material to at least partially fill the slots between segments of the frangible backup ring provides additional support, helps prevent the frangible backup ring from breaking prematurely during shipping or running-in-hole, and holds any pieces that happen to crack or break in place so that the pieces do not fall off the assembly. As such, one or more embodiments of the present disclosure improve the reliability of the downhole tool by reducing the likelihood of stuck in hole events during field introduction and preventing premature damage to the downhole tool.

Figure 1:
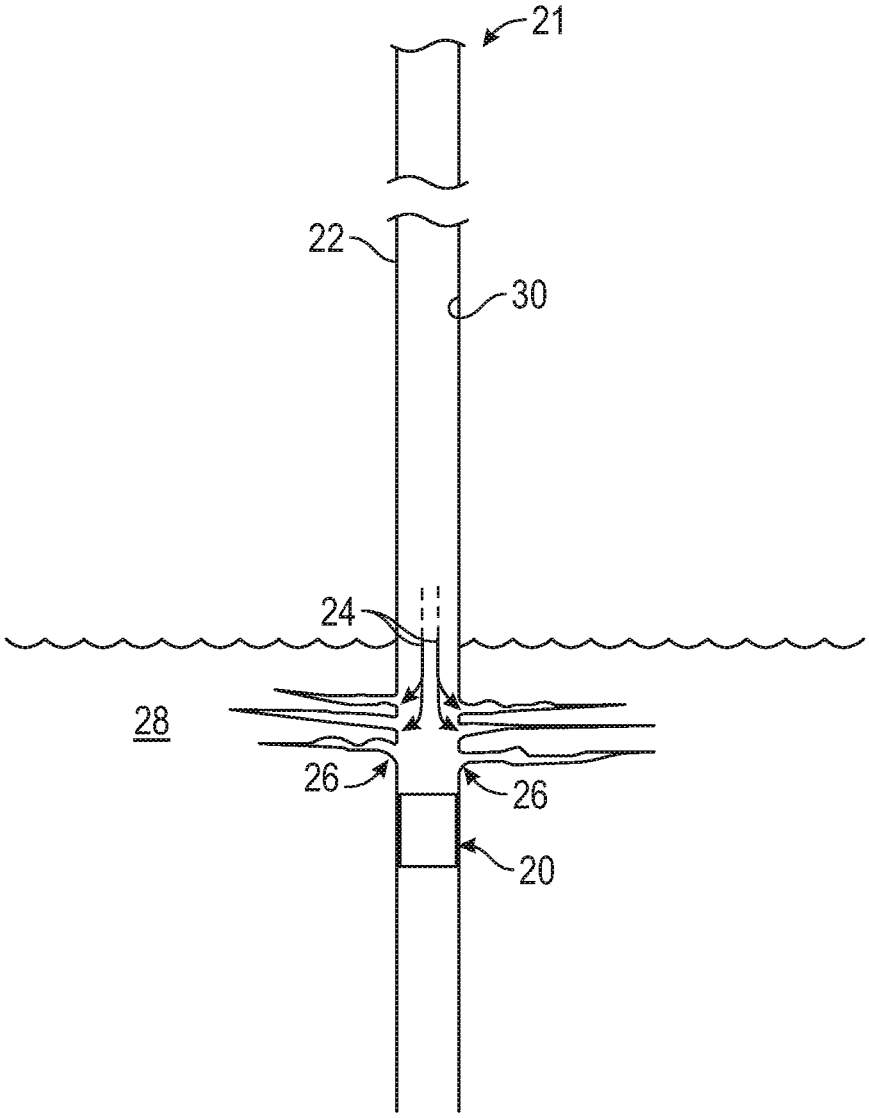
FIG. 1 is a schematic illustration of an example of a downhole tool deployed in a wellbore according to one or more embodiments of the present disclosure.

Referring generally to FIG. 1, an embodiment of a downhole tool 20 is illustrated deployed in a well 21. According to one or more embodiments of the present disclosure, the downhole tool 20 is a frac plug. For example, the frac plug 20 may be deployed in a wellbore 22 to facilitate a fracturing operation. In the example illustrated, the frac plug 20 is deployed in the wellbore 22 so as to isolate a zone of the wellbore 22 so that fracturing fluid 24 may be directed through perforations 26 and into a surrounding formation 28 uphole of the frac plug 20 for fracturing of the surrounding formation 28. It should be noted that the frac plug 20 according to one or more embodiments of the present disclosure may be used in many types of wellbores, such as deviated, e.g., horizontal, wellbores to facilitate fracturing of desired well zones along the horizontal or otherwise deviated wellbore.

Still referring to FIG. 1, the wellbore 22 may be lined with a casing 30, and each frac plug 20 may be actuated to grip into and seal against the casing 30, thereby sealing or substantially restricting flow of the fracturing fluid 24 downhole of the frac plug 20 in the wellbore 22. As a result, during a fracturing operation, the fracturing fluid 24 is directed through the perforations 26 into the surrounding formation 28 while the frac plug 20 remains anchored to the casing 30. Once the fracturing operation is completed and a given frac plug 20 is no longer of use, the frac plug may be milled and removed from the wellbore 22.

Figure 2:
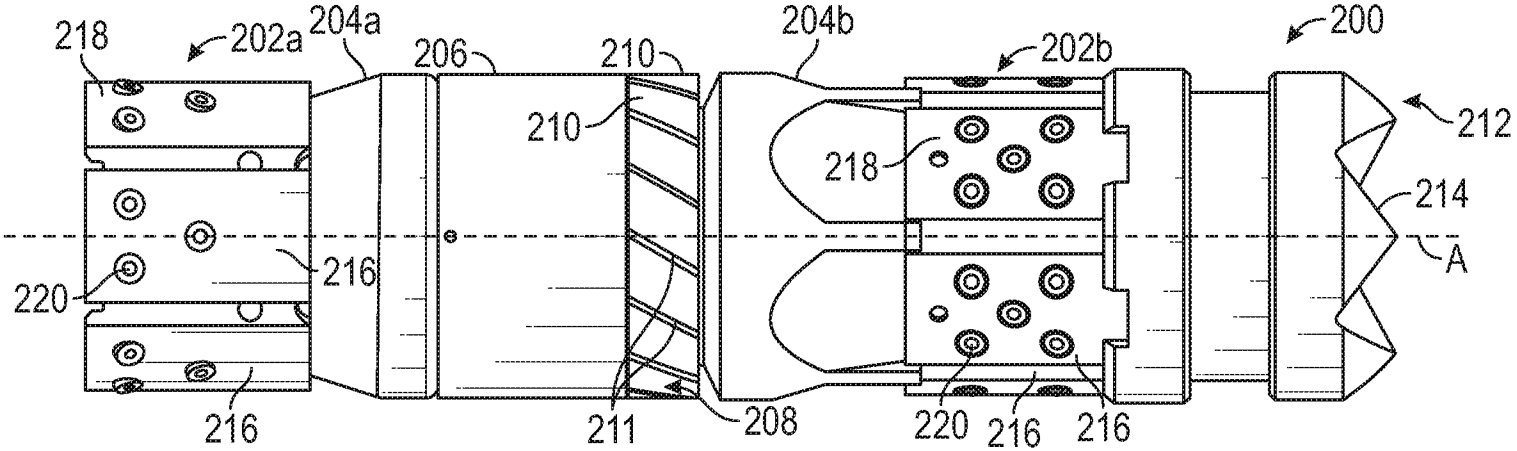
FIG. 2 is a perspective view of a frac plug according to one or more embodiments of the present disclosure.
Figure 3:
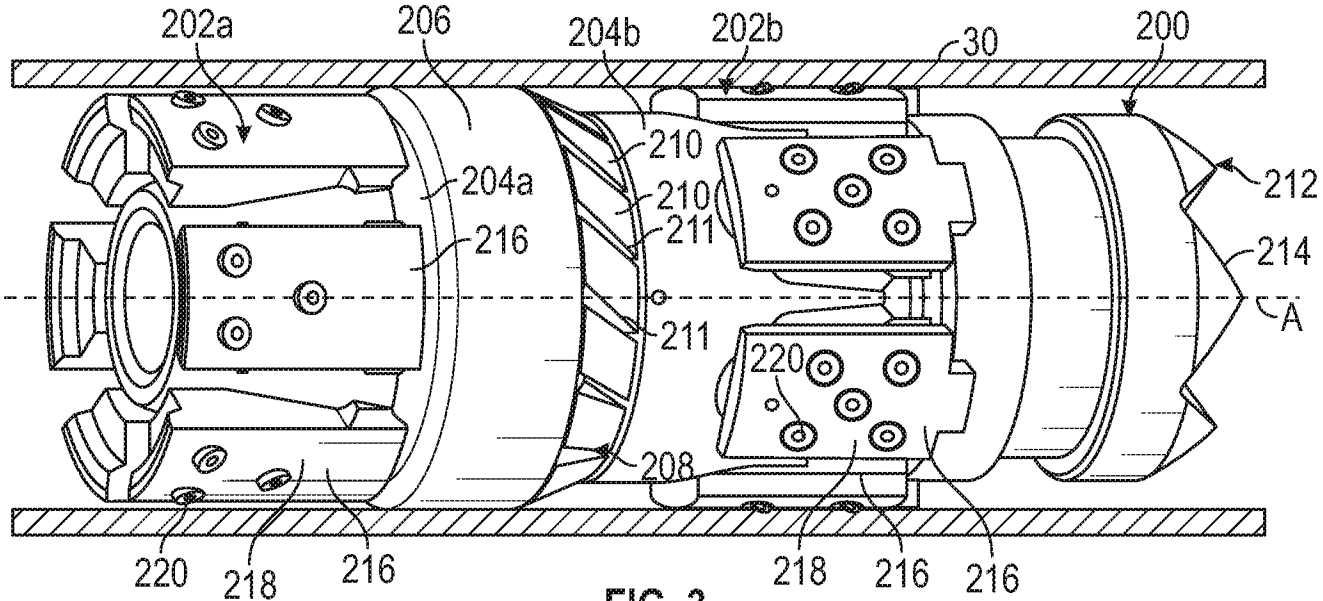
FIG. 3 is the frac plug of FIG. 2 set in casing according to one or more embodiments of the present disclosure.

Referring now to FIG. 2, a perspective view of a frac plug according to one or more embodiments of the present disclosure is shown. Specifically, FIG. 2 shows the frac plug 200 in an unset position. Referring also to FIG. 3, the frac plug 200 of FIG. 2 is shown set in the casing 30. According to one or more embodiments, the frac plug 200 may include a mandrel (not shown) and at least upper and lower slip assemblies 202*a*, 202*b*, upper and lower cones 204*a*, 204*b*, a sealing element 206, and at least one backup ring 208 disposed around the mandrel. In one or more embodiments, the at least one backup ring 208 is disposed adjacent the sealing element 206, and the at least one backup ring 208 may include a plurality of segments 210, which may radially expand against an inner wall of the casing 30 and create a circumferential barrier to keep the sealing element 206 from extruding. According to one or more embodiments of the present disclosure, the plurality of segments 210 of the at least one backup ring 208 may be made out of a frangible material. For example, a frangible material may break up into fragments. As an example, one or more components of a downhole tool such as a composite frac plug 200 may be made at least in part from a frangible material such that upon exposure to a condition, a range of conditions, etc. that material breaks into fragments. As further shown, the plurality of segments 210 may be defined by a plurality of slots 211, wherein each segment 210 is defined by a sequential pair of the plurality of slots 211. As further described below, a resilient matrix material may at least partially fill each slot of the plurality of slots 211 according to one or more embodiments of the present disclosure. The frac plug 200 may also include a bottom sub 212 having a chamfered end 214 according to one or more embodiments.

Still referring to FIGS. 2-3, the frac plug 200, including the at least one backup ring 208, may extend along longitudinal axis A. For orientation purposes, the plurality of slots 211 may extend parallel to one another and non-parallel to the longitudinal axis A in accordance with one or more embodiments of the present disclosure. The plurality of slots 211 may also extend parallel to the longitudinal axis A without departing from the scope of the present disclosure.

Still referring to FIGS. 2-3, the upper and lower slip assemblies 202*a*, 202*b* of the frac plug 200 may include a plurality of slips 216. Further, each slip 216 may include a slip body 218 and at least one button 220 disposed in the slip body 218. When the frac plug 200 transitions from the run-in-hole (RIH) unset position of FIG. 2 to the set position of FIG. 3, the upper slip assembly 202*a* ramps down the upper cone 204*a*, and the lower slip assembly 202*b* ramps up the lower cone 204*b*, causing the upper and lower slip assemblies 202*a*, 202*b* to radially expand. The radial expansion of the upper and lower slip assemblies 202*a*, 202*b* causes the at least one button 220 disposed in the slip body 218 of a given slip 216 to grip and bite into the inner diameter of the casing 30. Further, when the frac plug 200 is in the set position, the sealing element 206 is deformed into sealing engagement with the surrounding casing 30. According to one or more embodiments of the present disclosure, the sealing element 206 may be formed of an elastomeric material or metal material, which is deformed in a radially outward direction until forming a permanent seal with the inside surface of the casing 30. Due to the gripping and biting of the at least one button 220 and the sealing of the sealing element 206, the frac plug 200 is able to be effectively anchored to the inside surface of the casing 30 when the frac plug 200 is in the set position. The frac plug 200 may remain anchored to the inside surface of the casing 30 during a fracturing operation, and after the fracturing operation, the frac plug 200 may be drilled out, as previously described.

Still referring to FIGS. 2-3, the plurality of segments 210 of the at least one backup ring 208 may be cut or otherwise integrated into the lower cone 204*b* of the frac plug 200 according to one or more embodiments of the present disclosure. As previously mentioned and as further described below, a resilient matrix material may at least partially fill each slot 211 between the plurality of segments 210 of the at least one backup ring 208 according to one or more embodiments of the present disclosure. Advantageously, the resilient matrix material is stiff enough to prevent the at least one backup ring 208 from migrating during shipping or vibration during RIH, and pliable enough so as to not impede the necessary break out of the plurality of segments 210 and the radially outward expansion of the sealing element 206 during the setting operation of the frac plug 200, as previously described.

Figure 5:
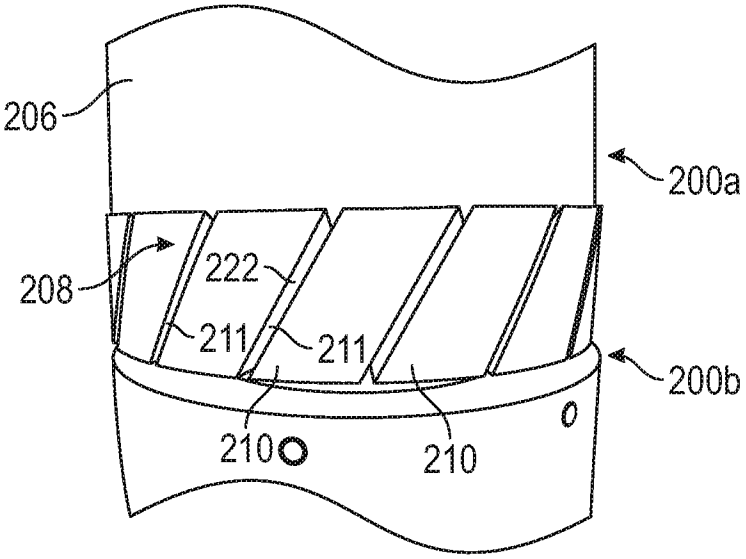
FIG. 5 shows a frac plug according to one or more embodiments of the present disclosure.
Figure 4:
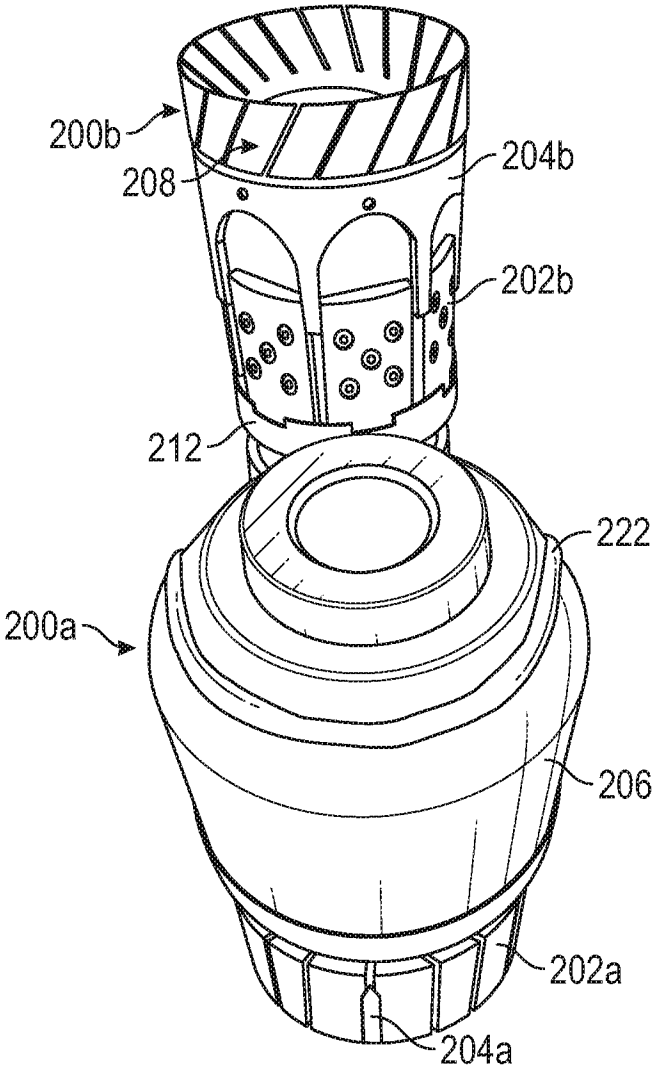
FIG. 4 shows a resilient matrix material applied to a frac plug according to one or more embodiments of the present disclosure.

Referring now to FIG. 4, a resilient matrix material 222 applied to a frac plug 200 according to one or more embodiments of the present disclosure is shown. As shown in FIG. 4, for example, the frac plug 200 may include two subcomponents—a first subcomponent 200*a* that includes the sealing element 206, the upper slip assembly 202*a*, and the upper cone 204*a*, and a second subcomponent 200*b* that includes the at least one backup ring 208, the lower slip assembly 202*b*, the lower cone 204*b*, and the bottom sub 212. As shown in FIG. 4, the resilient matrix material 222 may be applied to an end of the sealing element 206 of the first subcomponent during the assembly of the frac plug 200 according to one or more embodiments of the present disclosure. Specifically, as shown in FIGS. 4 and 5, the resilient matrix material 222 may be applied using an applicator, such as a caulk gun or a grease gun for example, as an uncured liquid gel (e.g., silicone, nitrile, HNBR, other rubbers, or other elastomers) such that the resilient matrix material 222 is applied between the sealing element 206 and the at least one backup ring 208 when the frac plug 200 is assembled by mating the first subcomponent 200*a* with the second subcomponent 200*b*. As the first subcomponent 200*a* mates with the second subcomponent 200*b*, the resilient matrix material 222 at least partially fills each slot of the plurality of slots 211 between each segment 210 of the at least one backup ring 208 (FIG. 5). In other embodiments, the resilient matrix material 222 entirely fills each slot of the plurality of slots 211 between each segment 210 of the at least one backup ring 208. Thereafter, the uncured liquid gel of the resilient matrix material 222 that partially fills each slot of the plurality of slots 211 cures into a solid, thereby providing additional support to the plurality of segments 210 of the at least one backup ring 208. That is, the resilient matrix material 222 according to one or more embodiments of the present disclosure helps hold the fragile backup segments 210 in place until they are broken out by the plug setting tool. The cured resilient matrix material 222 is essentially a molded-to-form, elastic retainer for the delicate backup segments 210 without having to actually include a retainer ring or over-molded rubber in the assembly. In this way, the resilient matrix material 222 according to one or more embodiments of the present disclosure simplifies the assembly of the frac plug 200 and provides a significant cost savings.

In addition to the aforementioned application method, other application methods of the resilient matrix material 222, which would achieve the same function (e.g., over-molding, sprayable compound, painted-on compound, heat shrink tape, etc.), are contemplated and are within the scope of the present disclosure. That is, rather than filling the plurality of slots 211 of the at least one backup ring 208, the resilient matrix material 222 may be applied topically to the at least one backup ring 208 according to one or more embodiments of the present disclosure. As an alternative to applying the resilient matrix material 222 between the sealing element 206 and the at least one backup ring 208 during assembly of the frac plug 200 as previously described, the resilient matrix material 222 may be applied separately to the at least one backup ring 208 without departing from the scope of the present disclosure.

According to one or more embodiments of the present disclosure, once cured, the resilient matrix material 222 is stiff enough to prevent the plurality of segments 210 of the at least one backup ring 208 from breaking or migrating during ordinary wear and tear (i.e., shipping and vibration from RIH). Moreover, the resilient matrix material 222 according to one or more embodiments of the present disclosure is pliable enough that the at least one backup ring 208 and sealing element 206 are able to break out and set normally with a standard setting tool. The resilient matrix material 222 according to one or more embodiments of the present disclosure also maintains its properties to an acceptable degree at elevated temperatures (up to 275° F., for example), so that the matrix functionality is not lost.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method, comprising:

assembling a downhole tool, the downhole tool comprises a first subcomponent and a second subcomponent;

the first subcomponent comprising a sealing element comprising a metallic or cured elastomeric material, an upper slip assembly, and an upper cone; then applying an uncured elastomer liquid gel to an end of the sealing element of the first subcomponent;

coupling the first subcomponent to the second subcomponent;

the coupling causes the uncured elastomer liquid gel to at least partially fill each slot of a plurality of slots of a backup ring via coupling the second subcomponent of the downhole tool to the first subcomponent, the second subcomponent comprising a lower slip assembly, a lower cone, and the backup ring;

the backup ring comprising:

a plurality of segments defined by the plurality of slots, wherein each segment is defined by a sequential pair of the plurality of slots; and then allowing the uncured elastomer liquid gel to cure into a solid.

2. The method of claim 1, wherein the uncured elastomer liquid gel comprises at least one of silicone or rubber.

3. The method of claim 1, wherein the uncured elastomer liquid gel entirely fills each slot of the plurality of slots.

4. The method of claim 1, wherein the plurality of segments is made out of a frangible material.

5. The method of claim 1, further comprising deploying the downhole tool into a cased wellbore.

6. The method of claim 1, further comprising anchoring the downhole tool to the cased wellbore.

* * * * *